United States Patent [19]

Rohloff

[11] Patent Number: 4,948,034

[45] Date of Patent: Aug. 14, 1990

[54] CARD CALENDAR

[76] Inventor: Charles A. Rohloff, P.O. Box 400, Territorial Rd., Evansville, Wis. 53536

[21] Appl. No.: 415,198

[22] Filed: Sep. 29, 1989

[51] Int. Cl.[5] ..... B65D 27/00

[52] U.S. Cl. ..... 229/92.8; 40/122; 229/70; 283/2

[58] Field of Search ..... 283/2, 3, 4; 40/107, 40/122; 229/70, 73

[56] References Cited

U.S. PATENT DOCUMENTS

| | | | |
|---|---|---|---|
| 296,934 | 4/1884 | Cussons | 40/122 |
| 376,506 | 1/1888 | Bote | 283/2 |
| 1,019,275 | 3/1912 | Press | 40/122 |
| 2,045,944 | 6/1936 | Domke . | |
| 2,243,974 | 6/1941 | Mitchell . | |
| 2,263,528 | 11/1941 | Wissman . | |
| 2,277,265 | 3/1942 | Zahniser . | |
| 2,282,630 | 5/1942 | Winford . | |
| 2,354,589 | 7/1944 | Georgi | 283/2 |
| 2,417,982 | 3/1947 | Histed . | |
| 2,436,105 | 2/1948 | Fisler | 283/2 |
| 2,560,766 | 7/1951 | Holland | 40/122 |
| 2,681,175 | 6/1954 | David | 229/73 |
| 3,652,007 | 3/1972 | MacDougall | 229/73 |
| 3,894,755 | 7/1975 | Cieslak et al. . | |
| 4,079,881 | 3/1978 | Sabb . | |
| 4,276,703 | 7/1981 | Brindley . | |
| 4,515,838 | 5/1985 | Miyajima . | |
| 4,589,590 | 5/1986 | McGuire et al. . | |
| 4,613,157 | 9/1986 | Drabish . | |
| 4,681,253 | 7/1987 | Engelhardt . | |
| 4,720,123 | 1/1988 | Chelius . | |
| 4,757,624 | 7/1988 | Holec . | |
| 4,780,975 | 11/1988 | Friedman . | |

OTHER PUBLICATIONS

A "Rural Companies" return envelope (date unknown).

*Primary Examiner*—Stephen P. Garbe

*Attorney, Agent, or Firm*—Andrus, Sceales, Starke & Sawall

[57] ABSTRACT

A card calendar is disclosed which has a paper blank cut and folded to present a card panel adjacent along a score line to a seal panel which is adjacent along a fold line to an envelope pocket formed of an envelope back attached by glue flaps to an envelope front, and a calendar panel adjacent to the envelope front along a score line with an alternative calendar panel adjacent to the calendar panel along a fold line. A two-flap illustrated greeting card is removably affixed to the card panel above a calendar printed on or attached to the calendar panel. When the calendar has expired, the greeting card may be placed within the envelope pocket, the card flap and calendar panels detached along the score lines, the seal panel adhesively fixed to the envelope front, and the card and envelope then mailed.

9 Claims, 3 Drawing Sheets

CARD CALENDAR

FIELD OF THE INVENTION

This invention relates to calendars in general and to calendars with removable greeting cards in particular.

BACKGROUND OF THE INVENTION

Display calendars, having an artistic image area adjacent to a monthly or annual calendar and adapted for wall or table display are well known. Common varieties of this type of calendar are those which feature spiral bound pages with an image area on one side of the page and a calendar for the preceding month on the other side of the page. Also common are calendars featuring image areas and calendar pages bound separately so that a calendar page may be changed without disturbing the image area page, or vice versa.

The image areas of calendars are usually printed on high quality card stock or coated papers, and often contain photographs or artworks of lasting value or interest. A drawback to this type of calendar is that, when the calendar has expired, the image area is usually discarded.

To make further use of the discarded image area, calendars have been designed utilizing detachable postcards, as disclosed in U.S. Pat. No. 2,263,528 to Wissman and in U.S. Pat. No. 4,757,624 to Holec. The value of a calendar is increased to a consumer when he may reuse the image areas at no additional cost. However, postcards are of limited use, mainly being sent to friends and aquaintances when traveling, or when time is not available to send a more formal greeting. Greeting cards of the simple two-flap type may be sent at any time of the year and indicate greater attention to the recipient. The value of a calendar would be greatly increased if the image areas of the calendar could be easily used as common greeting cards, after the calendar had expired.

SUMMARY OF THE INVENTION

The present invention is directed to a card calendar comprising a paper blank including a card panel and a seal panel adjacent to the card panel along a score line. An envelope back panel is adjacent to the seal panel along a fold line, and has one or more glue flaps. An envelope front panel is adjacent to the envelope back panel along another fold line. A calendar panel is adjacent to the envelope front panel along a score line. The envelope front panel is folded to overlie the envelope back panel and the glue flaps of the envelope back panel are affixed to the envelope front panel to form an envelope pocket. A greeting card which is adapted to fit within the envelope pocket is removably affixed to the card panel. A calendar is affixed to the calendar panel. The card calendar of this invention is constructed so that a user may remove the greeting card from the card panel after the calendar has expired and may place the card in the envelope, pocket. The card panel and the calendar panel may then be separated along the score lines to leave a card and envelope combination suitable for mailing.

A number of card calendars may be joined along the upper edge of the card panels to present sequential calendars to cover any period of time.

A card calendar according to this invention enables the repeated use of a pictorial display or greeting card first in a display mode in connection with a calendar and second in a mailing mode as a mailable card for personal or holiday messages.

The card calendar of this invention with an alternate calendar panel enables the same card calendar to be kept on sale for up to 2 years.

Further objects, features, and advantages of the invention will be apparent from the following detailed description taken in conjunction with the accompanying drawings showing the preferred embodiment of the invention.

DESCRIPTION OF THE PREFERRED EMBODIMENT

Figure 1:
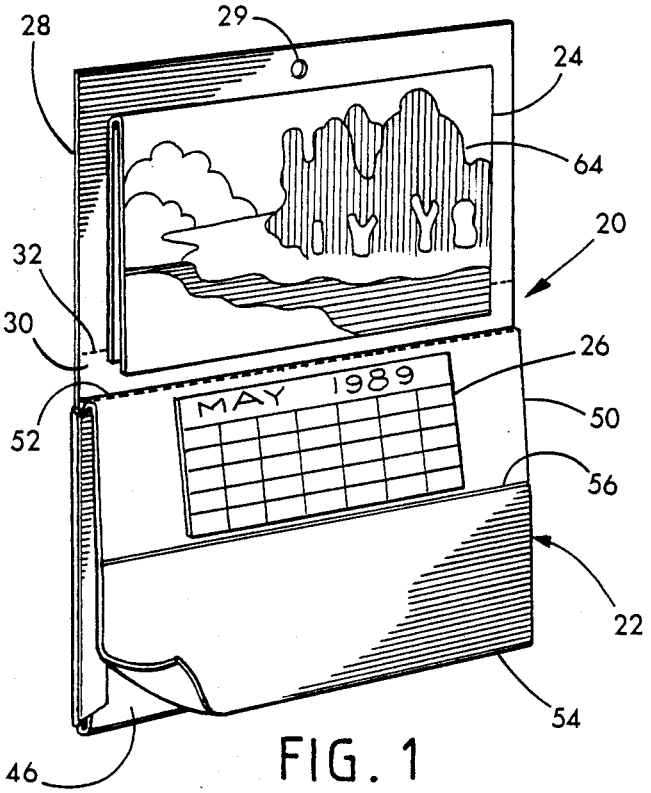
FIG. 1 is a perspective view of a card calendar of this invention.

Referring now to the figures wherein like numerals refer to similar parts, FIGS. 1–5 illustrate a card calendar 20, which includes a foldable paper blank 22 to which are affixed a card 24 and a calendar 26. The card 24 may be of the single sheet postcard-type or of the multi-part novelty type, but is preferably a two-flap folded card printed on heavy card stock. The calendar 26 is a standard design calendar covering any desired time period, from one day to a year or longer. As illustrated successively in FIGS. 1–5, the paper blank 22 serves two primary functions. First, in a calendar mode, the paper blank 22 forms a backing for both the card 24 and the calendar 26, as illustrated primarily in FIGS. 1 and 4. Second, in an envelope mode, the paper blank 22 may be altered to form an envelope 27 for the card 24, as illustrated primarily in FIG. 5.

Figure 2A:
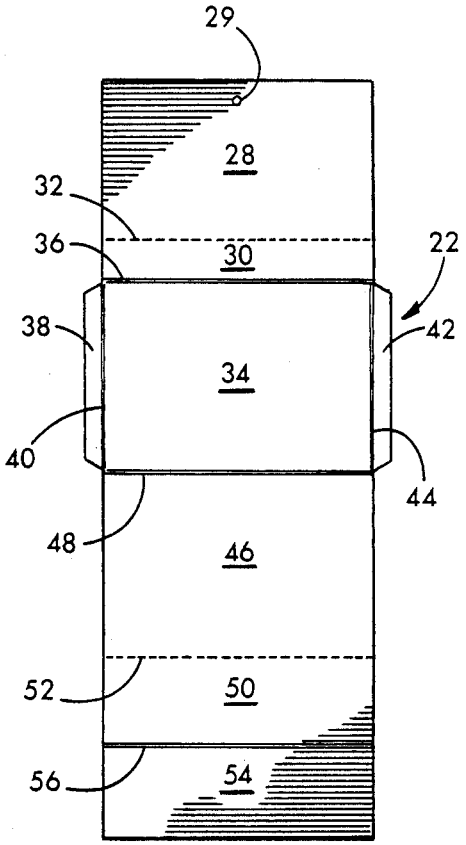
FIG. 2*a* is a plan view of the paper blank of the card calendar of this invention.
Figure 2B:
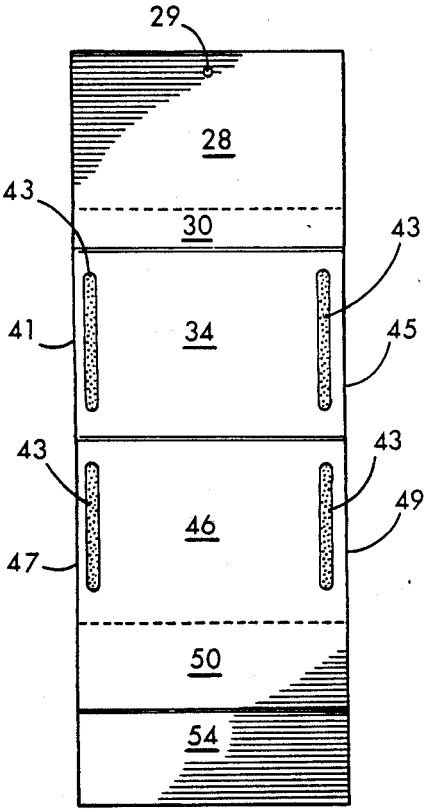
FIG. 2*b* is a plan view of an alternative embodiment of the paper blank of FIG. 2*a*.

As illustrated in FIG. 2*a*, the paper blank 22 may be formed of a single sheet of paper cut to desired dimensions and provided with perforations and fold line as will be explained hereinafter. The paper blank 22 includes fold lines 36, 40, 44, 48 and 56, indicated by solid interior lines, and score lines 32 and 52, indicated by broken interior lines. The score lines are preferably perforated, which serve to facilitate tearing of the paper blank. The paper blank 22 includes a card panel 28 adapted to removably receive a card 24 and a seal panel 30, preferably adhesively coated, adapted to seal the envelope 27 when in the envelope mode, the seal panel 30 being separated from the card panel 28 by the score line 32. An envelope back panel 34, which forms the back of the envelope 27 when the paper blank is folded and assembled, is separated from the seal panel 30 by the fold line 36. The envelope back 34 includes a first glue flap 38 separated by the fold line 40, and a second glue flap 42 separated by the envelope back 34 by the fold line 44. The glue flaps are generally outwardly extending paper flaps that serve to affix the envelope back 34 to the envelope front panel 46, which is adjacent the envelope back panel along the fold line 48. A calendar panel 50 adapted for printing or otherwise affixing a calendar is situated adjacent the envelope front panel 46 and separated therefrom by the score line 52. Optionally, an alternate calendar panel 54, also adapted for the printing or other affixing of a calendar, may be located adjacent the calendar panel 50 and separate therefrom by the fold line 56.

The paper blank 22 is preferably formed of any paper appropriate for use as an envelope such as a medium weight opaque bond paper but may also be fabricated of fabric or an appropriate flexible plastic material. In general the material forming the paper blank 22 will be chosen to coordinate in color and texture with the appearance of the card 24. The dimensions of the paper blank 22 may vary depending on the size of the card 24 used in the card calendar 20. The envelope back panel 34 and all the vertically adjacent portions of the paper blank 22 should be slightly wider than the width of the card 24. The envelope back panel 34 and the envelope front panel 46 are of equivalent dimensions and should be slightly taller than the height of the card 24. The combined height of the calendar panel 50 and the alternate calendar panel 54 is substantially the same as that of the envelope back panel 34. The seal panel 30 is large enough to have sufficient area to form a tight seal when coated with adhesive and used to close the envelope as described below. The combined height of the card panel 28 and the adjacent seal panel 30 is slightly greater than the height of the card 24 to accommodate to card 24.

It is within the scope of the present invention to omit the glue flaps 38, 42 from the paper blank 22 as illustrated in FIG. *2b*. In this situation, an adhesive 43 would be placed either adjacent the side edges 41, 45 of the envelope back panel 34 or the side edges 47, 49 of the front panel 46. The size of the card 24 would of course have to be adjusted accordingly to accommodate the sealed edges.

Figure 3:
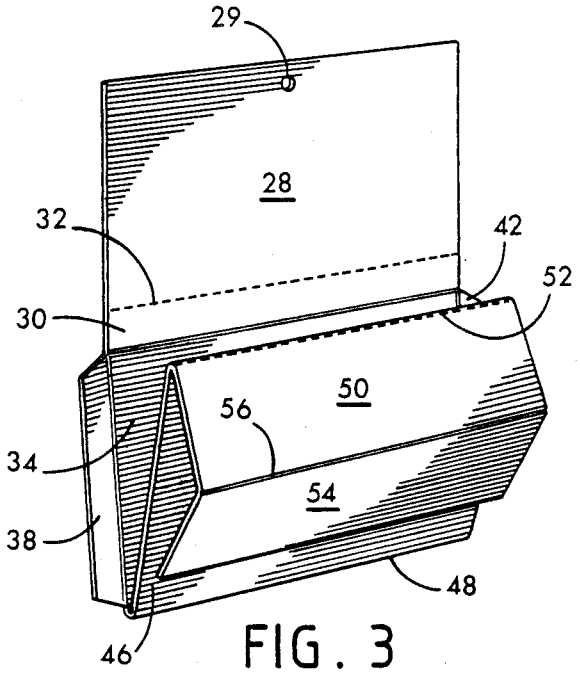
FIG. 3 is a perspective view of the paper blank of FIG. 2 in a partially folded condition.
Figure 4:
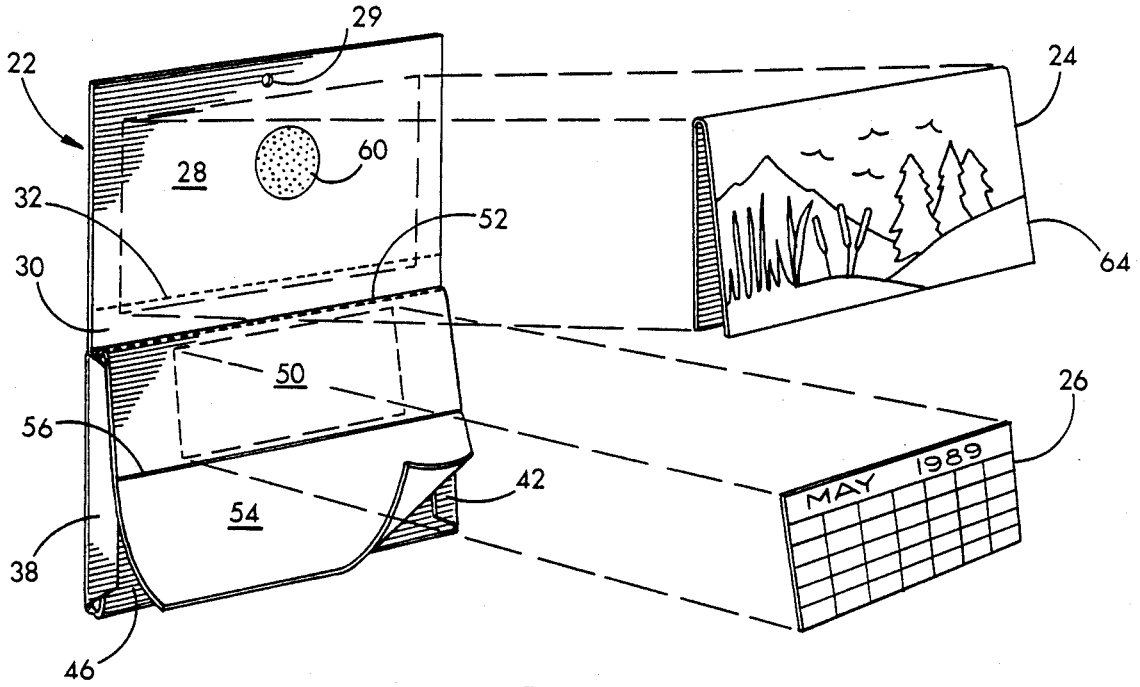
FIG. 4 is an exploded view of the card calendar of this invention.

The card calendar 20 is formed by folding the paper blank 22 and assembling it, the card 24, and the calendar 26 as best shown in FIGS. 3 and 4. The paper blank 22 is folded as illustrated in FIG. 3 by folding the envelope front panel 46 and the envelope back panel 34 together at fold line 48. The glue flaps 38, 42 on the envelope back panel 34 are then folded along the fold lines 40 and 44 respectively. An adhesive is applied to the backs of the glue flaps 38, 42 which are pressed into contact with the envelope front panel 46 which is folded along the fold line 48. The envelope front panel 46 when sealed to the glue flaps 38,42 then overlies the envelope back panel 34 to form an envelope pocket 58, illustrated in FIG. 5, adapted to receive the card 24.

The combined calendar panel 50 and alternate calendar panel 54 are folded along the fold line 52 so as to overlie the envelope front panel 46. The card panel 28 has an adhesive area 60, illustrated in FIG. 4, formed by an applied tacky adhesive, such as rubber cement, beeswax, a polymeric adhesive or any other adhesive which allows removable attachment of the card 24. The adhesive area 60 has sufficient adhesive strength to hold the card 24 securely to the card panel 28 yet still permit the card to be lifted from the card panel 28 without tearing the card panel 28 or the card 24. The calendar 26 may be a separate paper item as illustrated in FIG. 4 or it may be printed directly onto the calendar panel 50 as illustrated in FIG. 1.

The image area 64 of the card 24 serves as the decorative image area for the card calendar 20. With the card 24 affixed to the card panel 28 the card calendar 20 may be displayed. The image area 64 presents an attractive appearance, and the calendar 26 being clearly presented for reference directly beneath. The calendar 26 occupies only one half of the combined depth of the calendar panel 50 and the alternate calendar panel 54. The face of the alternate calendar panel 54 on the same side as the calendar 26 may be used for writing notes or appointments beneath the calendar 26. Alternately, this space may be used for promotional purposes for the placement of advertisements or commercial coupons. The card-calendar 20 may be conveniently hung on a wall by placing a wall hanger opening 29 in the paper blank 22.

Figure 8:
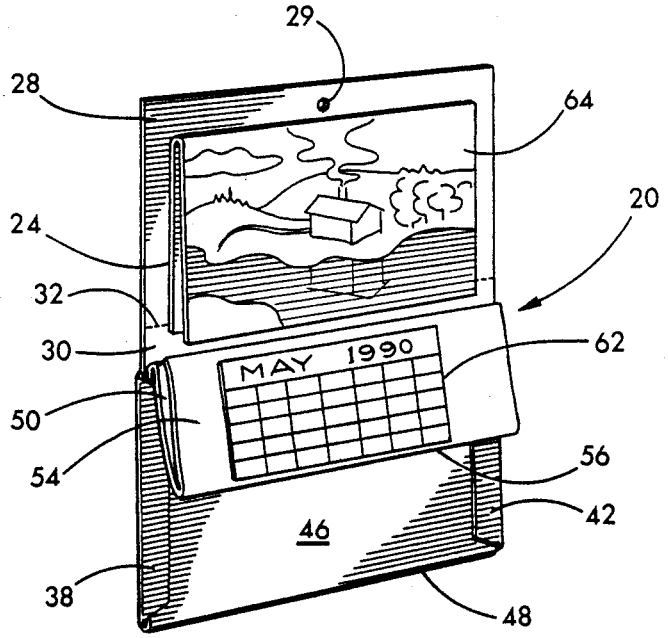
FIG. 8 is a perspective view of yet another embodiment of the present invention illustrating a card calendar of this invention with the alternate calendar folded into view.

Optionally, the alternate calendar panel 54 may be provided with a second calendar 62 mounted on its reverse side covering a different period of time than the calendar 26, as illustrated in FIG. 8. For example, the alternate calendar 62 could cover a month subsequent to the month covered by the calendar 26. In this way, a single card calendar may serve for a two-month period. The alternate calendar 62 is brought into view as shown in FIG. 8 by folding the alternate calendar panel 54 along the fold line 56 so that the alternate calendar panel 54 overlies the calendar panel 50. The alternate calendar panel may then be taped, stapled, glued or otherwise affixed into place. Alternatively, the face of the alternate calendar panel 54 continuous with the face of the calendar panel 50 carrying the calendar 26 may be provided with a tacky adhesive so that when the alternate calendar panel 62 is pressed into place over the calendar panel 50 it will be adhesively restrained.

Figure 5:
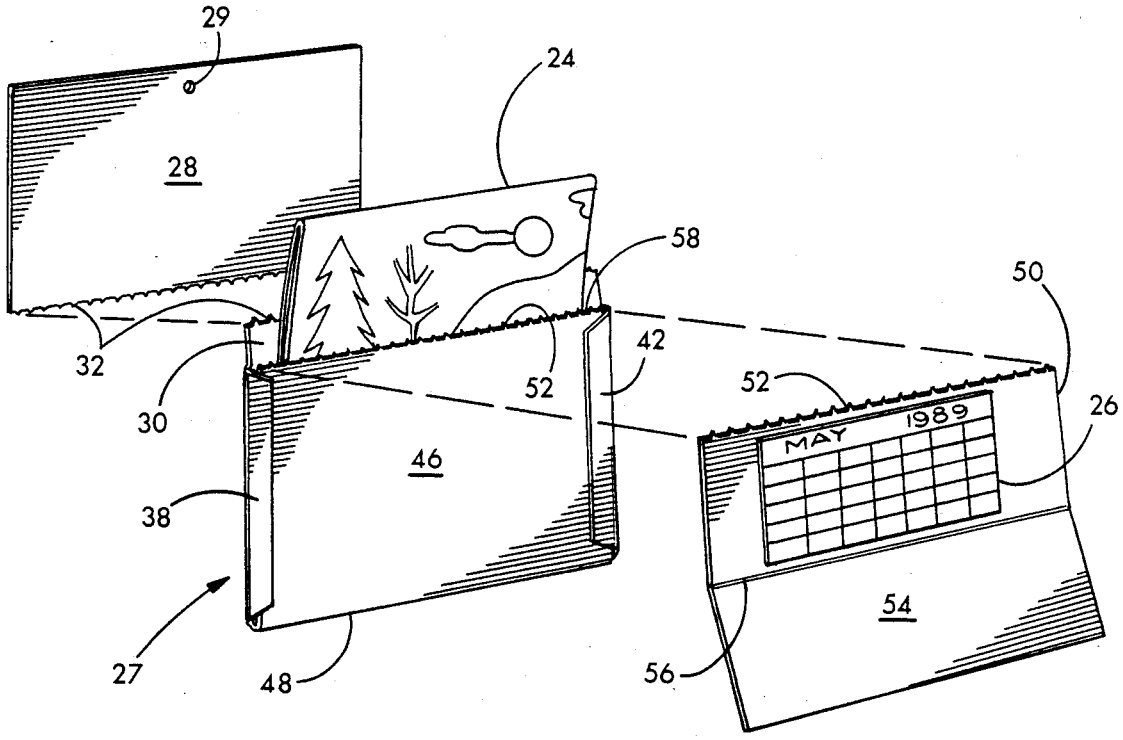
FIG. 5 is an exploded view of the card of the card calendar partially inserted in the envelope pocket with the discarded portions of the card calendar visible.

After the periods covered by the calendars 26, 62 of the card calendar 20 have passed, the card 24 may be used as a greeting card. To use the card 24 as a greeting card the card 24 is removed from the adhesive area 60 of the card panel 28, the desired message is written in the interior of the card 24, and the card 24 is inserted into the envelope pocket 58, as illustrated in FIG. 5. The card panel 28, which is no longer of utility, is removed by tearing along the score line 32. In like manner, the expired calendars 26, 62, the calendar panel 50 and the alternate calendar panel 54 are removed by tearing along the score line 52. These panels 50, 54 may be retained by the user for his records if he wishes to preserve the notes or memorandums written there. What remains is a card 24 within an envelope 27 with an envelope pocket 58 and a seal panel 30. The seal panel 30 is then folded along the fold line 36 and sealed with glue or other adhesive to the envelope front panel 46. Preferably, an adhesive coating is placed on the seal panel 30 such that when water is applied to the coating and the seal panel 30 is pressed into place the envelope 27 is sealed. The envelope 27, with the card 24 sealed in the envelope pocket 58, is ready to be deposited in the mail.

Figure 6:
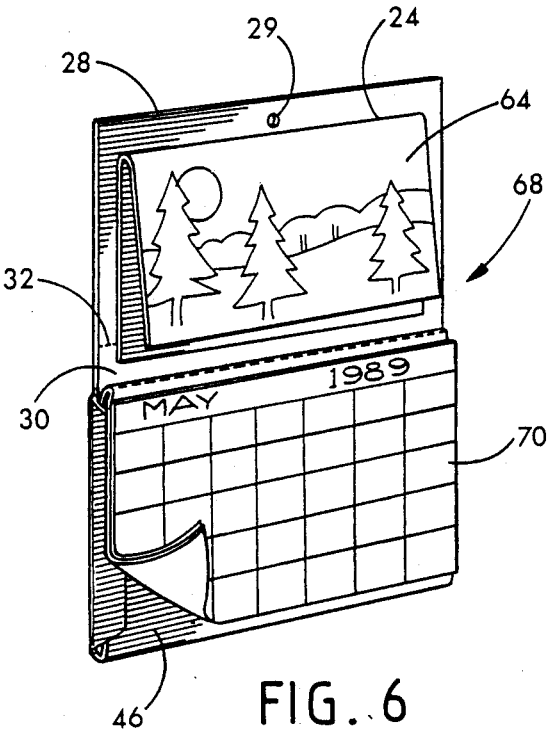
FIG. 6 is a perspective view of another embodiment of this invention having one large calendar.

A second embodiment of the card calendar of this invention is shown in FIG. 6. This card calendar 68 has a single large calendar 70 which fully overlies the envelope front panel 46.

Figure 7:
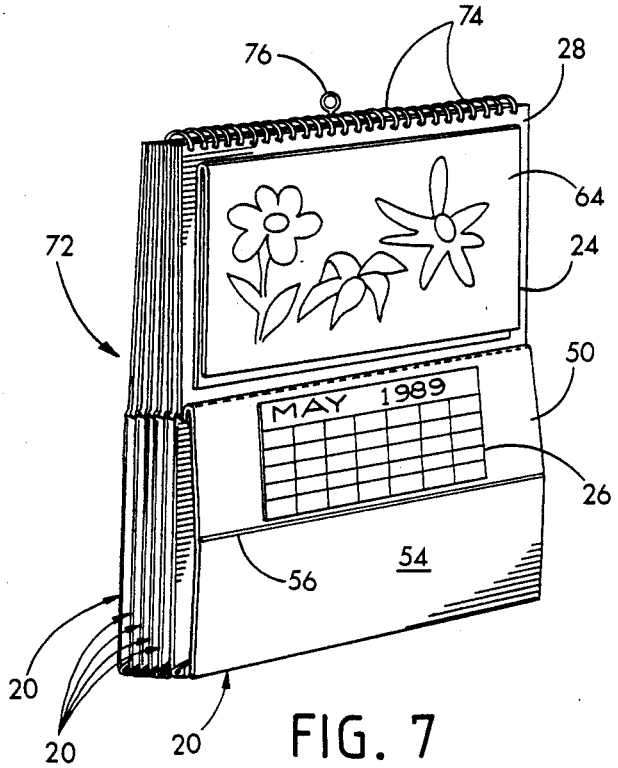
FIG. 7 is a perspective view of a one-year assembly of card calendars.

A number of card calendars 20 may be combined into a card calendar assembly 72 to collectively cover an extended period of time. As shown in FIG. 7, the individual card calendars 20 are joined along the top edge of the card panels 28 by a binding 74. This binding 74 may be a plastic tension binder, or other looped binder, but it is preferably a wire or plastic spiral binder running through holes punched in the top portion of the card panels 28. For display of the card calendar assembly 72 on a vertical surface, such as a wall, a hanger 76 may be provided attached to the binding 74. The individual card calendars 20 are displayed sequentially in the card calendar assembly 72. As the period covered by a card calendar 20 expires, that card calendar is removed from the card calendar assembly 72 by tearing along the binding 74. The card 24 may then be used as a greeting card as described above.

In the card calendar assembly 72 the alternate calendar panels 54 serve to extend the useful period covered by the card calendar assembly 72. Each alternate calendar 62 may cover a month one year in advance of the calendar 26. A card calendar assembly 72 thus equipped with 12 card calendars 20 each with a calendar covering one month and an alternative calendar 62 covering a one-month period one year after that covered by the calendar 26 will have a one-year period during which the card calendar assembly 72 will still cover a full year's period. A card calendar assembly 72 so equipped with calendars and alternate calendars may be started at any time during a year at any month in the calendar. For example, if the card calendar assembly 72 is started in January of the on-sale year, the calendars 26 for January through December of that year will be used. However, if the card calendar assembly 72 is started in February of the on-sale year, the calendars 26 will be used for February through December, and then the alternate calendar 62 will be flipped up and used for January of the succeeding year.

The card calendar assembly 72 serves also as a convenient storage article for cards 24. A card is always available within easy reach and readily visible. If the cards 24 are detachably mounted with a reuseable tacky adhesive on the individual card calendars 20 within the assembly, the cards 24 with different views may be rearranged at will to suit the desires of the viewer. A card may be removed from the card calendar for a month in the future and mailed in the envelope 27 from an expired card calendar 20, the card from the expired card calendar being reaffixed to the card panel for the future month.

The paper blank 22 of the card calendar 20 may be printed in a number of ways to make the article more useful. Informational or commercial messages may be imprinted on the alternate calendar panel 54 or on the card panel 28, or instructional messages regarding the use and assembly of the card calendar itself may be printed at appropriate locations on the card calendar 20.

The card calendar assembly 72 may also be advantageously used as a promotional item. Businesses with year around activities, such as recreational and sporting events, may use the assembly 72 for an entire year of promotion convering all months and various uses of their seasonal products or services. In addition to printing advertisements or coupons on the alternate calendar panel 54, an advertiser may make use of the calendar panel 50, the card panel 28 and the card 24 itself for additional messages.

It should be noted that instead of binding the card calendars 20 together with a spiral binding, staples, adhesives, spikes, or hooks may also be used. Furthermore, the dimensions of the card calendar 20 and the paper blank 22 may be varied to accommodate cards 24 of different size and shape. Furthermore, a number of card calendars 68 with a single large calendar 70 can also be collected into a card calendar assembly. Also, score lines may alternatively be fold lines.

It is understood that the invention is not confined to the particular construction and arrangement herein illustrated and described, but embraces such modified forms thereof as come within the scope of the following claims.

What is claimed is:

1. A card calendar comprising:

(a) a paper blank including a card panel having an upper edge, a seal panel adjacent to the card panel along a score line, an envelope back panel adjacent to the seal panel along a fold line, an envelope front panel adjacent to the envelope back panel along a fold line, and a calendar panel adjacent to the envelope front panel along a score line, wherein the envelope front panel is folded to overlie the envelope back panel and affixed to the envelope front panel to form an envelope pocket;

(b) a card adapted to fit within the envelope pocket and removably affixed to the card panel; and (c) a calendar affixed to the calendar panel.

2. The card calendar of claim 1 further comprising an alternate calendar panel adjacent to the calendar panel along a fold line.

3. The card calendar of claim 1 wherein the envelope back panel has two glue flaps, and wherein the envelope pocket is formed by affixing the envelope front panel to the glue flaps.

4. A card calendar assembly comprising a plurality of card calendars, each card calendar including:

(a) a paper blank including a card panel having an upper edge, a seal panel adjacent to the card panel along a score line, an envelope back panel adjacent to the seal panel along a fold line, an envelope front panel adjacent to the envelope back panel along a fold line, and a calendar panel adjacent to the envelope front panel along a score line, wherein the envelope front panel is folded to overlie the envelope back panel and affixed to the envelope front panel to form an envelope pocket;

(b) a card adapted to fit within the envelope pocket and removably affixed to the card panel; and (c) a calendar affixed to the calendar panel wherein the card calendars are joined together by binding along the upper edge of each of the card calendars.

5. The card calendar assembly of claim 4 wherein each card calendar ha an alternate calendar panel adjacent the calendar panel along a fold line.

6. The card calendar of claim 4 wherein the envelope back panel of each card calendar has two glue flaps, and wherein the envelope pocket is formed by affixing the envelope front panel to the glue flaps.

7. An envelope blank comprising:

(a) a card panel adapted to removably receive a card;

(b) a seal panel adjacent to the card panel along a score line;

(c) an envelope back panel adjacent to the seal panel along a fold line;

(d) an envelope front panel adjacent to the envelope back panel along a fold line and adapted to fold over and overlie the envelope back panel and to be affixed to the back panel;

(e) means to affix the envelope front panel to the envelope back panel;

(f) a calendar panel adjacent to the envelope front panel along a score line and adapted to receive a calendar; and (g) an alternate panel adapted to receive a calendar or a message, the alternate panel being adjacent to the calendar panel along a fold line.

8. The card calendar of claim 7 wherein the envelope back panel has two glue flaps, and wherein an envelope pocket is formed by affixing the envelope front panel to the glue flaps.

9. A card calendar comprising:

(a) an envelope blank including a unitary sheet of paper stock having a series of generally parallel score lines and generally parallel fold lines dividing the sheet into separate panels, wherein the sheet includes a first score line separating a card panel from an adjacent seal panel, a first fold line generally parallel to the first score line and separating the seal panel from an adjacent envelope back panel, a second fold line generally parallel to the first fold line and separating the envelope back panel from an adjacent envelope front panel, wherein the envelope back panel includes a first edge and a second edge, the first and second edges being generally parallel to each other and perpendicular to the first and second fold lines, the firs edge forming a third fold line separating a first glue panel from the envelope back panel and the second edge forming a fourth fold line separating a second glue panel from the envelope back panel, and a second score line generally parallel to the second fold line separating the envelope from an adjacent calendar panel;

(b) a card removably affixed to the card panel of the envelope blank; and (c) a calendar removably affixed to the calendar panel of the envelope blank.

* * * * *